United States Patent [19]

Godderidge

[11] 4,339,909

[45] Jul. 20, 1982

[54] ROTARY QUADRANTS OF CABLE-MAKING MACHINES

[76] Inventor: Jean Godderidge, 11 boulevard H. Barbusse, 78800 Houilles, France

[21] Appl. No.: 166,409

[22] Filed: Jul. 7, 1980

[30] Foreign Application Priority Data

Jul. 9, 1979 [FR] France ..... 79 17786

[51] Int. Cl.[3] ..... D07B 3/12; D01H 7/24; D01H 7/86

[52] U.S. Cl. ..... 57/58.52; 57/58.67; 57/58.7; 57/115

[58] Field of Search ..... 57/58.52–58.57, 57/58.36, 58.67, 58.7, 58.87, 115

[56] References Cited

U.S. PATENT DOCUMENTS

| | | | |
|---|---|---|---|
| 3,138,914 | 6/1964 | Blaisdell | 57/58.52 X |
| 3,564,831 | 2/1971 | Bonnabaud et al. | 57/58.52 |
| 3,793,819 | 2/1974 | Madalozzo et al. | 57/58.7 X |
| 3,812,666 | 5/1974 | Sarracino | 57/58.52 |
| 3,945,182 | 3/1976 | Dover et al. | 57/58.52 |

FOREIGN PATENT DOCUMENTS

| | | | |
|---|---|---|---|
| 1352139 | 9/1962 | France | 57/58.52 |
| 2837317 | 10/1978 | France . | |

*Primary Examiner*—Donald Watkins

*Attorney, Agent, or Firm*—Bell, Seltzer, Park & Gibson

[57] ABSTRACT

The present invention relates to improvements in rotary quadrants of cable-making machines, for use in the production of strands composed of elementary filaments, the said quadrant being constituted by a supple member fixed at its two ends on two support members driven in rotation about the same axis, so that, in the rest position, the strand to be produced is stretched between the two support members, and in the working position, the said strand comes, under the effect of the centrifugal force, in resting contact against the supple member.

The invention finds an application in cable-making machines.

3 Claims, 3 Drawing Figures

ROTARY QUADRANTS OF CABLE-MAKING MACHINES

The present invention relates to an improvement in rotary quadrants of cable-making machines.

In cable-making machines, it is known to use a rotary assembly currently styled quadrant, which permits the production of strands composed of elementary filaments of any nature, according to the method known as double-twisting.

The different quadrants known until now are separate quadrants and rigid or supple continuous quadrants. Said quadrants being composed of tubes, blades or massive filaments.

With said quadrants however, it is known to use members for guiding the strand, which members are mounted on the elongated element constituting the quadrant and it is the object of the present invention to eliminate the guiding members which present several disadvantages.

According to the present invention, the quadrant is composed of a supple member fixed at its two ends on two support members driven in rotation about the same axis, so that, in the rest position, the strand to be produced is stretched between the two support members, and in the working position, the said strand comes, under the effect of the centrifugal force, in resting contact against the supple member.

This particular arrangement of the transfer quadrant permits to eliminate any means provided for guiding the strand to be produced. In addition, the pulling pressures are reduced due to the shape of the transfer quadrant and its sound level is substantially reduced.

The invention will be more readily understood on reading the following description with reference to the accompanying drawings, in which.

Figure 1:
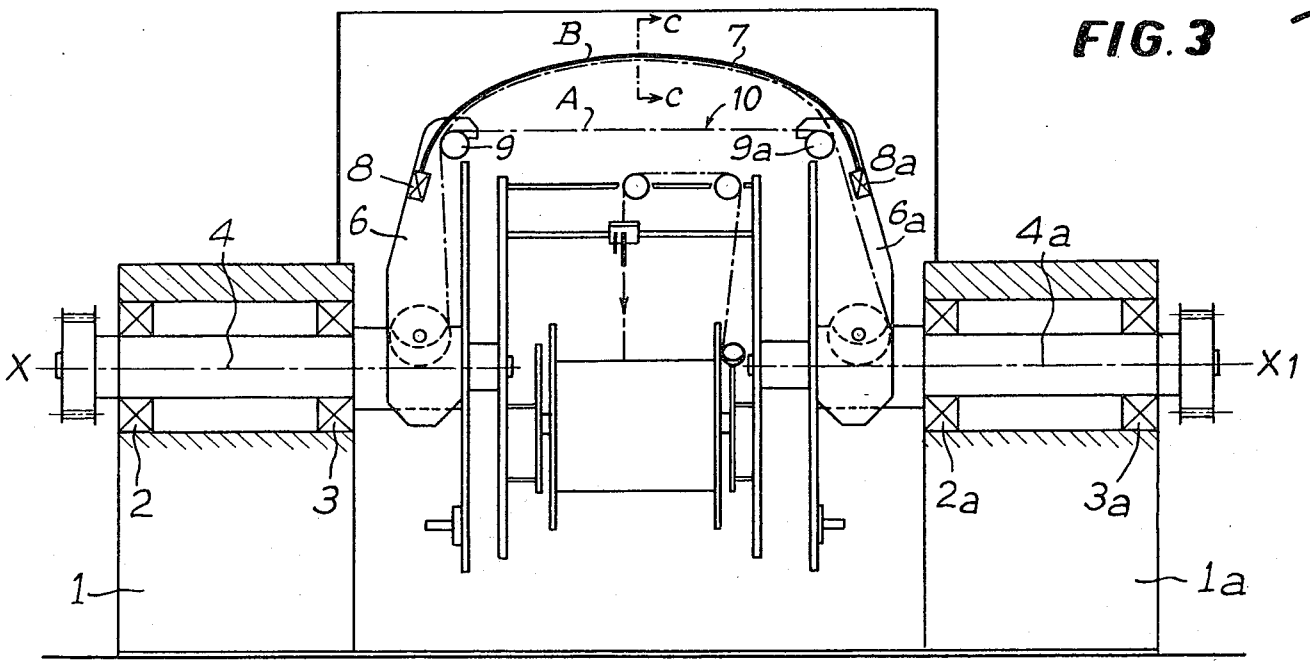
FIG. 1 is an elevational view of one embodiment of the improved quadrant according to the invention.

FIG. 1 shows two frames 1, 1*a* resting on the ground, and inside which are mounted for rotation, by means of bearings 2, 2*a* and 3, 3*a*, two split shafts 4, 4*a* aligned with an axis X,X1 and driven in rotation by pulleys 5, 5*a*. On said split shafts 4, 4*a* is mounted a quadrant according to the invention which comprises two support arms 6, 6*a* secured by one of their ends on the split shafts 4, 4*a* and extending radially with respect to the said split shafts.

Figure 2:
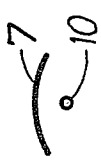
FIG. 2 is a cross-sectional view of the quadrant in the rest position, along line CC of FIG. 1.
Figure 3:
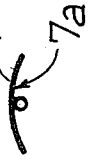
FIG. 3 is a cross-sectional view of the quadrant in the working position, along line CC of FIG. 1.

A supple member 7 is fitted in 8 on the support arms 6, 6*a*, which member is constituted, in the embodiment illustrated in FIGS. 2 and 3, by an incurved strip of steel or any other material.

Pulleys 9, 9*a* are mounted for free rotation at one of the ends of the support arms 6, 6*a*, on which pulleys is engaged the strand 10 to be produced.

In the rest position (FIGS. 1 and 2), the strand 10 to be produced is stretched between the two pulleys 9, 9*a* of the quadrant support and in said position A it is not in contact with the supple member 7 of the quadrant.

In the working position on the contrary, (FIGS. 1 and 3), the strand 10 which is subjected to the action of the centrifugal force, moves from the position A to the position B. The strand then comes to rest on the inner concave face 7*a* of the quadrant and thus remains in contact with the supple member 7 due to its incurved shape.

The invention is not limited to the embodiment described hereinabove and modifications may of course be brought thereto by any one skilled in the art without departing from the scope thereof.

What is claimed is:

1. In a double-twist stranding or cabling machine; the improvement of a rotary quadrant characterized by elimination thereon of prior conventional strand guiding members, said rotary quadrant comprising spaced-apart driven support members mounted for rotation in said machine about the same axis for engagably receiving the strand being processed, and an elongate incurved supple member without strand guides or enclosed conduits therein and extending between and mounted on opposite end to said respective support members, so that the strand being processed is stretched between said support members out of contact with said supple member when said machine is not operating and said rotary quadrant is at rest and the strand being processed is in contact with said supple member under the influence of centrifugal force when said machine is operating and said rotary quadrant is rotating.

2. In a double-twist stranding or cabling machine, as set forth in claim 1, in which said supple member includes a concave inner face for receiving the strand being processed when said machine is operating and said rotary quadrant is rotating.

3. In a double-twist stranding or cabling machine, as set forth in claim 1 or 2, in which each of said support members comprises an arm mounted for rotation at one end thereof and having a rotatable pulley mounted on the other end thereof for engagably receiving the strand being processed, and in which the opposite ends of said supple member are mounted on the other ends of said arms.

* * * * *